United States Patent [19]

Young

[11] Patent Number: 4,928,878

[45] Date of Patent: May 29, 1990

[54] FASTENING RAILS TO WOODEN SLEEPERS

[75] Inventor: Hartley F. Young, Victoria, Australia

[73] Assignee: Ralph McKay Limited, Maidstone, Australia

[21] Appl. No.: 163,192

[22] Filed: Feb. 25, 1988

Related U.S. Application Data

[63] Continuation of Ser. No. 822,883, Jan. 27, 1986, abandoned.

[30] Foreign Application Priority Data

Feb. 1, 1985 [AU] Australia ..... PG9104

[51] Int. Cl.[5] ..... E01B 9/28

[52] U.S. Cl. ..... 238/351; 238/366; 238/DIG. 1

[58] Field of Search ..... 238/310, 315, 321, 338, 238/343, 349, 351, 354, 366, 370, 371, 375, DIG. 1

[56] References Cited

U.S. PATENT DOCUMENTS

| | | | |
|---|---|---|---|
| 2,530,229 | 11/1950 | Clark | 238/366 |
| 2,690,879 | 10/1954 | Snyder | 238/371 |
| 2,886,248 | 5/1959 | Laudig | 238/DIG. 1 |
| 3,004,715 | 10/1961 | Gadd | 238/349 X |
| 3,067,947 | 12/1962 | Deenik et al. | 238/DIG. 1 |
| 3,356,300 | 12/1967 | Harrel | 238/366 |
| 4,267,970 | 5/1981 | Lubbers | 238/310 X |

FOREIGN PATENT DOCUMENTS

| | | | |
|---|---|---|---|
| 7810729 | 4/1980 | Netherlands | 238/310 |
| 8200669 | 3/1982 | World Int. Prop. O. | 238/351 |

*Primary Examiner*—Margaret A. Focarino
*Assistant Examiner*—Frank H. Williams, Jr.
*Attorney, Agent, or Firm*—Edwin T. Bean, Jr.; Martin G. Linihan; John C. Thompson

[57] ABSTRACT

Spikes for holding elastic rail clamps for use with wooden rail ties. The spike portion incorporating recesses in its surface to accommodate an adhesive which improves adhesions between the spike and the wooden tie. The lower end of the spike which faces the rail incorporates a series of ribs.

20 Claims, 4 Drawing Sheets

FASTENING RAILS TO WOODEN SLEEPERS

Figure 1:
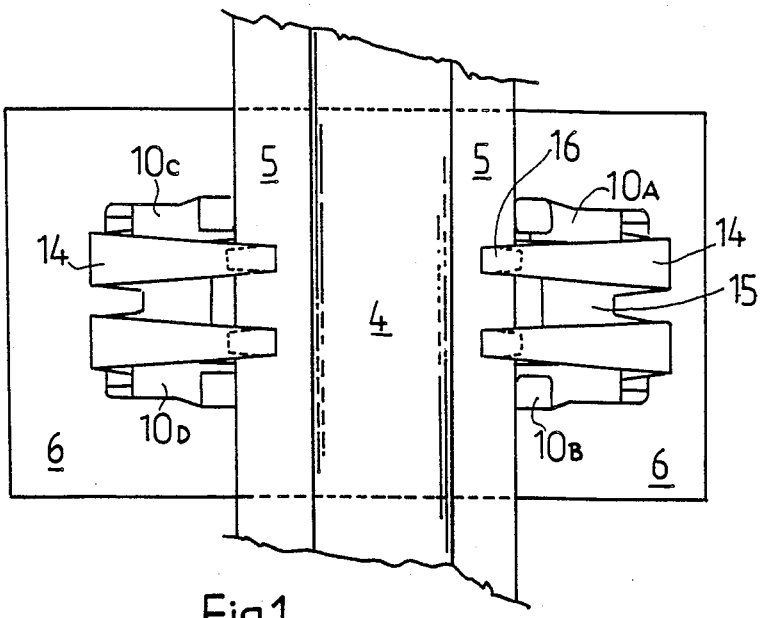

This application is a continuation, of application Ser. No. 822,883, filed Jan. 27, 1986 now abandoned.

This invention relates to rail fastening systems particularly those for use with wooden rail ties.

A problem with all elastic rail fastening systems is that the base of the rail clamp exerts a powerful upward force on the clamp holding means. With conventional rail spikes upward movement is created by movement of rolling stock over the rail whereas in elastic rail fastening systems the clamp holder is subject to a vertical force equal and opposite to the rail hold down force. With wooden rail ties the spike or rail clamp holder is either driven into the wooden rail tie or is a force fit into a drilled hole. Prior proposals for using elastic rail clamps with wooden sleepers have utilized spikes for holding the rail plate to the sleeper and the rail clamp in position. Typical of these prior proposals are U.S. Pat. Nos. 2,535,337 and 2,228,461. U.S. Pat. No. 2,652,982 discloses an elastic rail fastening for wooden rail ties wherein a spike is used as the rail fastening holder. The spike is held in the sleeper by frictional forces and additionally with adhesive applied to a pre-bored hole into which the spike is driven.

Unlike rail clamp holders for concrete rail ties the bottom of the rail clamp leg cannot be larger than the top if it is to be used with wooden rail ties. In wooden rail ties the rail clamp holder can only be held in place by friction. This holding force can be reduced by the drying out of the wood.

It is an object of this invention to provide a more effective means for holding rail clamp supports in wooden rail ties.

To this end the present invention provides a support for an elastic rail clamp to be inserted into wooden rail tie, said support including a clamp receiving portion adapted to be above the surface of the wooden rail tie and to receive a portion of the elastic rail clamp, and a second securing portion extending into the rail tie, said securing portion comprising a vertical leg portion having surface recesses over at least a portion of its surface and incorporating a series of ribs on the side of the lower end of said portion adapted to face the rail.

Preferably this invention provides a combination of a wooden rail tie and rail clamp support in which the portion of the rail clamp support vertically embedded in the rail tie includes horizontally oriented recesses filled with an adhesive and the lower end of said portion which faces toward the rail is serrated.

A preferred form of this invention utilizes the wooden rail fastening system of Australian patent No. 537442 which proposed a novel approach to fastening systems for wooden rail ties whereby a rail plate is provided to lie between the rail tie and the rail support plate is held in position by a pair of attachment means which also hold the elastic rail fasteners in position at right angles to the rails longitudinal direction. The base of the rail fastener seats in opposed recesses of the shoulders of the pair of attachment pegs.

Accordingly this invention also provides a rail fastening system comprising a wooden rail tie, a rail having a longitudinal axis, a rail plate positioned between the tie and the rail, two pairs of attachment means associated with each rail plate, each pair being located on opposite sides of the rail and each attachment means is alongside of the rail to secure the plate to the wooden tie, each attachment means including a recess and further having located below said recess, a spike portion extending through the plate and into the tie, and an elastic rail clamp associated with each pair of attachment means, the clamp having one portion lying on the rail flange and another portion held within opposed facing recesses of the associated pair of attachment means wherein the spike portion of said attachment means incorporates surface recesses over at least a portion of said surface to accommodate adhesive which promotes adhesion between the wooden rail tie and the spike portion and said spike portion further incorporating a series of ribs on the side of the lower end of said spike portion facing said rail.

The rail clamp holders which receive the base portion of the rail clamp are subject to a force which has a component that tends to push the bottom end of the rail clamp holder toward the rail. This is caused by the upward reaction from the clip toes being eccentric from the spike center line and thereby applying a rotating movement to the rail clamp holders. The provision of ribs tends to improve the grip between the rail tie, the rail clamp support and resists the vertical pull out tendency of the rail support.

The recesses provided on the spike portion of the rail clamp support ensure sufficient contact between the adhesive, the wooden rail tie and the rail clamp support.

A preferred form of this invention utilizes epoxy polymers as the adhesive to assist in bonding the rail clamp support to the rail tie.

The epoxy polymer serves two functions—the first being an adhesive to hold the spike in place and the second to provide a seal at the top of the spike to prevent water ingress between the wood and the spike.

Conventional dog spikes have the problem that water entering at the top between the spike and the wood combines with acids naturally occuring in the wood (acetic acid) and forms a galvanic electric cell which causes rapid corrosion of the spike with more acids as by products. The acids weaken the wood and crumbling corrosion material reduce the grip on the wood and both are major factors in spike loosening. These problems are overcome with this invention.

It has been found that these benefits are not obtained by dipping a conventional dog spike in resin before driving the spike in because the wood just wipes the resin off the spike and thereby prevents satisfactory glueing or sealing.

If the resin is applied to the hole first instead much more resin is used which is very expensive and the wood interference still wipes the resin off the top part of the spike thus preventing adequate sealing and adhesion.

This invention provides a way to provide adequate sealing at the top of the spike plus adhesion over the entire length of the spike.

The benefits arising from this are a long maintenance free life.

The recesses are preferably provided on opposite faces of the lower portion which are approximately parallel to the rail. The faces of the lower portion oriented at right angles to the rail may incorporate recesses or ribs of a different pattern.

It has been found that using the rail clamp support of this invention with an epoxy adhesive as outlined above enables softwood sleepers to be used and these have proved to be just as effective as the conventional hardwood sleepers but are less expensive.

Figure 2:
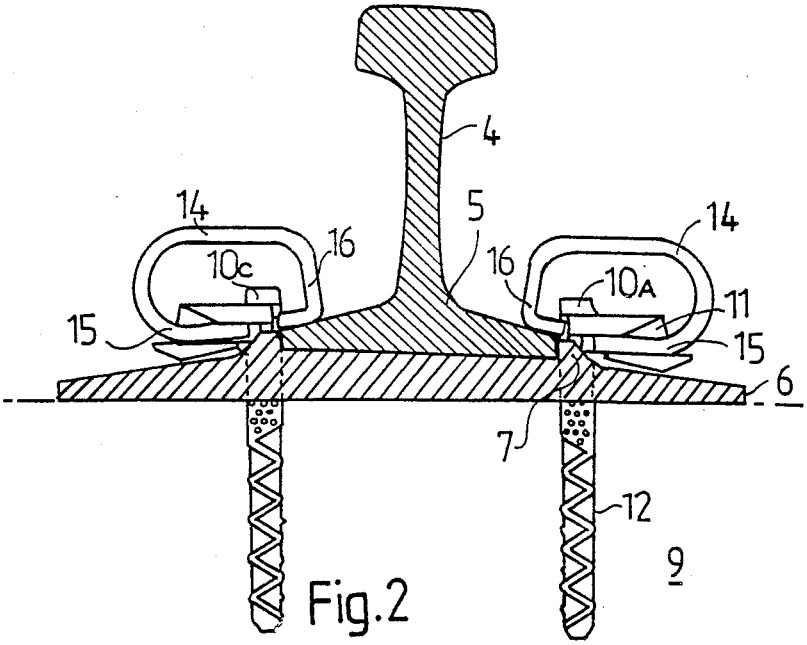
Figure 3:
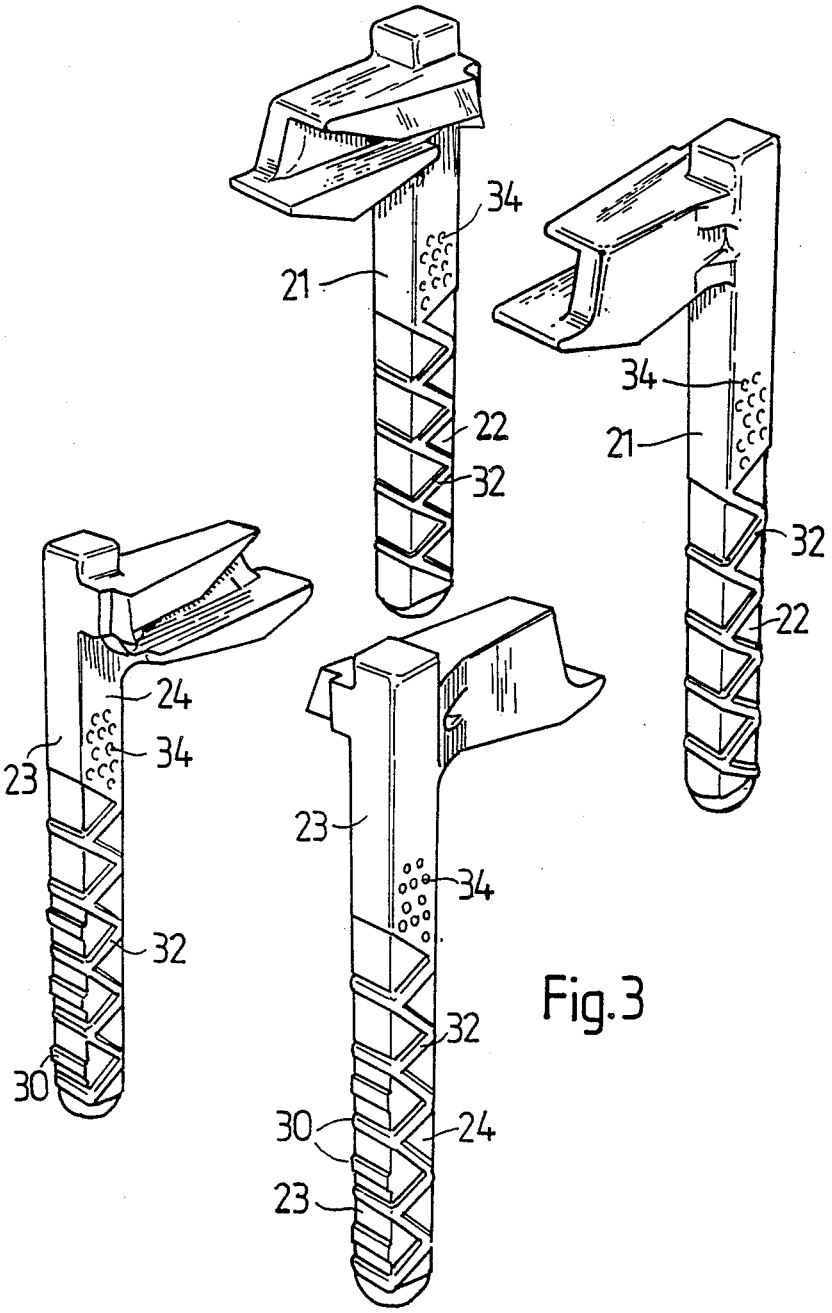
Figure 4:
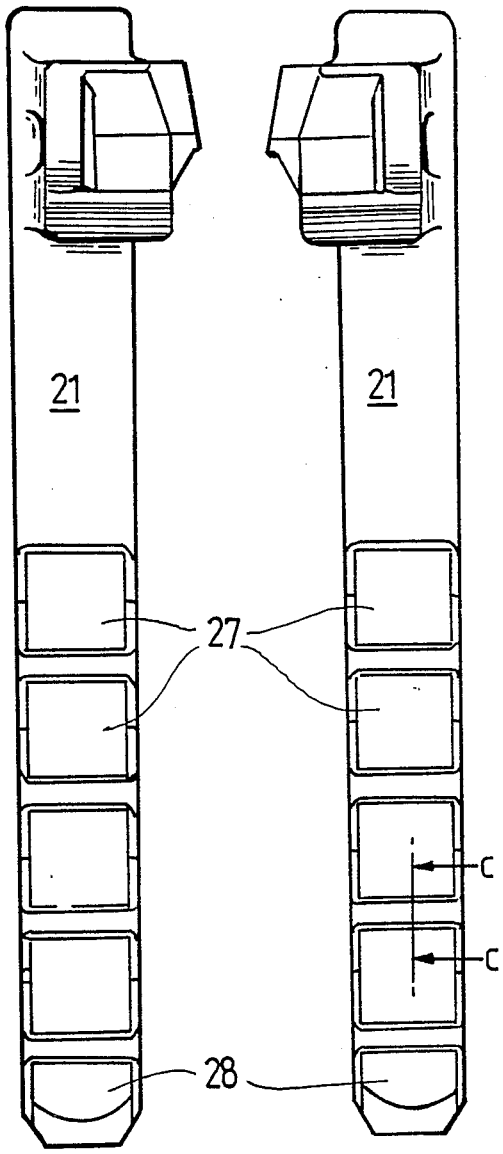
Figure 5:
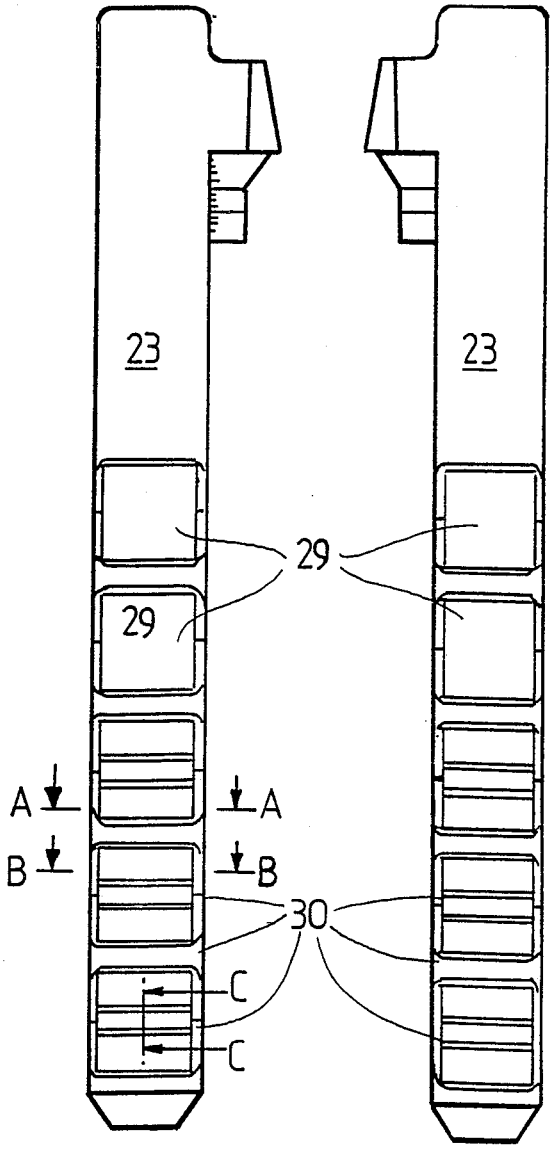

A preferred embodiment of this invention will now be described with reference to the drawings in which FIG. 1 is a plan view of a rail seat, FIG. 2 is a sectional view of a rail seat, FIG. 3 is a perspective view of four attachment means forming a rail seat, FIG. 4 is a front view of a pair of attachment means and FIG. 5 is a rear view of a pair of attachment means.

The rail 4 sits on a rail plate 6 which is fastened to the wooden rail tie 9 by the attachment spikes 10. The spikes 10 extend through complementary holes in rail plate 6 and the tie attachment portions 12 extend into the wooden tie 9. The rail clamp receiving portion 11 of each attachment means 10 lies above the rail plate 6. The rail clamp 14 has a base portion 15 lying in the recess or slot of portion 11 of the attachment means and the toe portion 16 applies the hold down force on rail flange 5. The rail 4 sits between ribs 7 of rail plate 6.

After a hole has been prepared and the leg portions 12 have been coated with a suitable adhesive, the attachment means 10 are hammered vertically into position.

As seen in FIG. 4 the faces 21 of the leg portions 12 which are seen from a point at right angles to the rail, looking toward the rail, incorporate large square shallow recesses 27 and a partial recess 28 at the base of face 21. These recesses 27 are primarily to provide space for the adhesive to accumulate and are to ensure an effective metal to wood bond.

Face 23 of each leg portion 12 as shown in FIG. 5 incorporate recesses 29 similar to recesses 27. At the lower end of face 23 the recesses 29 are crossed by wide horizontal ribs 30 which effectively form with the raised portions between the recesses 29 some seven ribs 30 on the lower portion of face 23. Face 23 is opposite to face 21 on the leg portions 12 and is seen looking at right angles away from the rail. Because the rail clamp 14 imparts a component force tending to move the clamp receiving portion 11 away from the rail the low portion of face 23 and its ribs 30 are forced into the wood of rail tie 9.

Faces 22 and 24 of each leg portion 12 are basically similar in that they incorporate inclined ribs 32 which join the non-recessed portions of faces 21 and 23. Above the area of the inclined ribs 32 each of faces 22 and 24 incorporate a series of shallow semi spherical indentations 34 which are also useful for accumulation of adhesive.

From the above description it can be seen that the present invention provides an improved means of ensuring effective fastening of the rail clamp attachment means to a wooden rail tie.

The claims defining the invention are as follows:

I claim:

1. A support for an elastic rail clamp to be inserted into a wooden rail tie, said support including a receiving portion adapted to be above the surface of the wooden rail tie and to receive a portion of the elastic rail clamp, and a securing portion extending into the rail tie, said securing portion comprising a vertical leg portion having a longitudinal axis disposed in a plane substantially parallel to a plane established by the vertical center line of the rail, said vertical leg portion comprising a body having an outer surface, a lower end remote from said receiving portion and a side adapted to face the rail, said vertical leg portion having recesses relieved relative to said outer surface and located over at least a portion of said outer surface to accommodate an adhesive which promotes adhesion between the wooden rail tie and said securing portion, each of said recesses having an inner surface disposed in a plane substantially parallel to the plane of said outer surface, and said vertical leg portion including a series of raised ribs defined relative to said outer surface and located on the side of the lower remote end of said vertical leg portion adapted to face the rail which ribs are forced into said wooden tie when said rail clamp imparts a component force tending to move said receiving portion of said support away from the rail.

2. A support as claimed in claim 1 in which said outer surface of said vertical leg portion includes faces disposed substantially parallel to the rail, and said faces contain said recesses.

3. A support as claimed in claim 2 in which said outer surface of said vertical leg portion includes other faces disposed substantially perpendicular to the rail and said other faces of the leg portion are ribbed.

4. A support as claimed in claim 1, wherein each of said recesses is of a size and shape sufficient to accumulate an amount of adhesive which ensures an effective bond to said wooden tie.

5. A support as claimed in claim 1, wherein each of said recesses is rectangular in shape, large in surface area and shallow in depth.

6. A support as claimed in claim 1, wherein said inner surface of each of said recesses is relatively large in surface area and is located a relatively short distance inwardly from said outer surface.

7. A support as claimed in claim 1, wherein at least some of said recesses are located on said side of said vertical leg portion adapted to face the rail and along said lower remote end, and wherein each of said ribs is located in a corresponding one of said recesses extending outwardly from the inner surface of said recess, said ribs being disposed substantially perpendicular to the longitudinal axis of said leg portion.

8. A support as claimed in claim 7, wherein said recesses are located relatively closely together thereby defining raised surface portions between adjacent recesses, said raised portions being disposed substantially perpendicular to the longitudinal axis of said leg portion, said raised portions and said ribs being forced into said wooden tie when said rail clamp imparts a component force tending to move said receiving portion of said support away from the rail.

9. A rail fastening system comprising a wooden rail tie, a rail having a longitudinal axis and a vertical centerline establishing a vertical plane, a rail plate positioned between the tie and the rail, two pairs of attachment means associated with each rail plate, each pair being located on opposite sides of the rail and each attachment means is alongside of the rail to secure the plate to the wooden tie, each attachment means including a clamp-receiving recess and further having located below said recess, a spike portion extending through the plate and into the tie and having a longitudinal axis disposed in a plane substantially parallel to said vertical plane, and an elastic rail clamp associated with each pair of attachment means, the clamp having one portion lying on the rail flange and another portion held within opposed facing clamp-receiving recesses of the associated pair of attachment means, wherein said spike portion of said attachment means comprises a body having an outer surface, a lower end remote from said clamp-receiving recess and a side adapted to face the rail, said spike portion having recesses relieved relative to said outer surface and located over at least a portion of said outer surface to accommodate an adhesive which promotes adhesion between the wood rail tie and said spike portion, each of said recesses having an inner surface disposed in a plane substantially parallel to the plane of said outer surface, and said spike portion further incorporating a series of raised ribs defined relative to said outer surface and located on the side of the lower remote end of said spike portion facing said rail which ribs are forced into said wooden tie when said rail clamp imparts a component force tending to move the portion of said attachment means including said clamp-receiving recess away from the rail.

10. A rail fastening system as claimed in claim 9 wherein the adhesive used is an epoxy polymer based adhesive.

11. A rail fastening system as claimed in claim 10 wherein the adhesive also provides a seal to prevent ingress of water between the spike portion and the wooden tie.

12. A rail fastening system as claimed in claim 9 in which said outer surface of said spike portion includes faces which are substantially parallel to the rail and wherein said surface recesses are located on said faces.

13. A rail fastening system as claimed in claim 12 in which said outer surface of said spike portion includes other faces disposed substantially perpendicular to the rail and said other faces of said spike portion are ribbed.

14. A support as claimed in claim 9, wherein each of said spike recesses is of a size and shape sufficient to accumulate an amount of adhesive which ensures an effective bond to said wooden tie.

15. A support as claimed in claim 9, wherein each of said spike recesses is rectangular in shape, large in surface area and shallow in depth.

16. A support as claimed in claim 9, wherein said inner surface of each of said recesses is relatively large in surface area and is located a relatively short distance inwardly from said outer surface.

17. A support as claimed in claim 9, wherein at least some of said spike recesses are located on said side of said spike portion adapted to face the rail and along said lower remote end, and wherein each of said ribs is located in a corresponding one of said spike recesses extending outwardly from the inner surface of said spike recesses, said ribs being disposed substantially perpendicular to the longitudinal axis of said spike portion.

18. A support as claimed in claim 17, wherein said spike recesses are located relatively closely together thereby defining raised surface portions between adjacent recesses, said raised portions being disposed substantially perpendicular to the longitudinal axis of said spike portion, said raised portion and said ribs being forced into said wooden tie when said rail clamp imparts a component force tending to move the portion of said attachment means including said clamp-receiving recess away from the rail.

19. A support for an elastic rail clamp to be inserted into a wooden rail tie, said support including a receiving portion adapted to be above the surface of the wooden rail tie and to receive a portion of the elastic rail clamp, and a securing portion extending into the rail tie, said securing portion comprising a vertical leg portion having a longitudinal axis disposed in a plane substantially parallel to a plane established by the vertical center line of the rail, said vertical leg portion comprising a body having an outer surface, a lower end remote from said receiving portion and a side adapted to face the rail, said vertical leg portion having recesses relieved relative to said outer surface and located over at least a portion of said outer surface and being of a size and shape sufficient to accommodate an amount of adhesive which ensures effective adhesion between the wooden rail tie and said securing portion, each of said recesses having an inner surface relatively large in surface area and disposed in a plane substantially parallel to the plane of said outer surface and being located a relatively short distance inwardly from said inner surface so that said recesses are relatively shallow in depth, at least some of said recesses being located on said side of said vertical leg portion adapted to face the rail and along said lower remote end, said vertical leg portion including a series of raised ribs defined relative to said outer surface and located on the side of the lower remote end of said vertical leg portion adapted to face the rail, each of said ribs being located in a corresponding one of said recesses extending outwardly from the inner surface of said recesses, said ribs being disposed substantially perpendicular to the longitudinal axis of said leg portion, said recesses being located relatively closely together thereby defining raised surface portions between adjacent recesses, said raised portions being disposed substantially perpendicular to the longitudinal axis of said leg portion, said raised portions and said ribs being forced into said wooden tie when said rail clamp imparts a component force tending to move said receiving portion of said support away from the rail.

20. A support as claimed in claim 19, wherein each of said recesses is rectangular in shape.

* * * * *